US007883115B2

(12) United States Patent
Keefe

(10) Patent No.: US 7,883,115 B2
(45) Date of Patent: Feb. 8, 2011

(54) STAND-UP ADVERTISING INSERT

(76) Inventor: Richard Ignatius Keefe, 1017 Shore Acres Rd., Rock Falls, IL (US) 61071

( * ) Notice: Subject to any disclaimer, the term of this patent is extended or adjusted under 35 U.S.C. 154(b) by 818 days.

(21) Appl. No.: 11/510,011

(22) Filed: Aug. 25, 2006

(65) Prior Publication Data

US 2008/0067800 A1 Mar. 20, 2008

(51) Int. Cl.
*B42D 1/00* (2006.01)
*A63H 33/38* (2006.01)

(52) U.S. Cl. ..... 281/15.1; 281/3.1; 283/61; 283/63.1; 446/148

(58) Field of Classification Search ..... 283/56, 283/61, 63.1, 117, 106; 40/360, 124.08; 281/2, 3.1, 15.1, 51; 206/232, 767, 768; 156/223, 227, 291; 446/147–150; 428/40.1, 428/124
See application file for complete search history.

(56) References Cited

U.S. PATENT DOCUMENTS 1,545,141 A 7/1925 Friedrich
1,837,663 A 12/1931 Kadlec
1,913,797 A 6/1933 Dulin
1,969,768 A 8/1934 Robert
2,156,815 A 5/1939 Levy
2,309,244 A 1/1943 Fey
3,275,316 A 9/1966 Cleary, Jr.
3,582,111 A * 6/1971 Siiter ..... 283/56
3,691,140 A * 9/1972 Silver ..... 526/240
3,995,388 A 12/1976 Penick
4,103,444 A 8/1978 Jones et al.
4,163,548 A 8/1979 Nystrand
4,212,231 A 7/1980 Penick
4,337,589 A 7/1982 Volkert et al.
4,349,973 A 9/1982 Penick
4,408,755 A 10/1983 Meier
4,468,020 A 8/1984 Wallace
4,484,768 A * 11/1984 Norfleet ..... 283/116
4,554,193 A 11/1985 Erickson
4,657,612 A 4/1987 Schoenleber
4,726,972 A * 2/1988 Instance ..... 428/41.8
4,833,802 A 5/1989 Volkert
4,842,303 A * 6/1989 Molenda ..... 281/38
4,867,480 A 9/1989 Volkert
4,963,125 A 10/1990 Volkert
5,011,189 A 4/1991 Olson
5,022,681 A 6/1991 Penick
5,056,824 A 10/1991 Olson
5,074,595 A * 12/1991 Hill et al. ..... 283/81
5,249,827 A 10/1993 Olson (Continued)

*Primary Examiner*—Dana Ross
*Assistant Examiner*—Pradeep C Battula
(74) *Attorney, Agent, or Firm*—Erickson Law Group, PC

(57) ABSTRACT

A multi-page printed medium features an advertising insert and includes a first printed page and a second printed page, and an insert located between the first and second pages. The insert includes a sheet having a fold separating a first panel and a second panel with a bending memory along the fold. A portion of a first adhesive is applied between the first panel and the first page and a second portion of adhesive is applied between the second panel and the second page. The second portion of adhesive has lesser adhesion than the first portion of adhesive such that when the second printed page is moved away from the first printed page the second page separates from the second panel.

6 Claims, 4 Drawing Sheets

U.S. PATENT DOCUMENTS

| | | | | | |
|---|---|---|---|---|---|
| 5,332,265 | A | | 7/1994 | Groess | |
| 5,472,240 | A | * | 12/1995 | Davies | 283/116 |
| 5,582,888 | A | | 12/1996 | Volkert | |
| 5,687,495 | A | | 11/1997 | Volkert | |
| 5,758,438 | A | | 6/1998 | Crowell | |
| 5,813,596 | A | * | 9/1998 | Dahlquist | 40/124.08 |
| 5,933,989 | A | | 8/1999 | Volkert | |
| 5,943,800 | A | | 8/1999 | Rose | |
| 5,967,557 | A | * | 10/1999 | Dahlquist | 283/56 |
| 5,983,538 | A | | 11/1999 | Crowell | |
| 6,044,490 | A | | 4/2000 | Volkert | |
| 6,068,903 | A | | 5/2000 | Volkert | |
| 6,092,317 | A | | 7/2000 | Volkert | |
| 6,113,148 | A | | 9/2000 | Koranda | |
| 6,192,608 | B1 | | 2/2001 | Williams | |
| 6,213,520 | B1 | * | 4/2001 | Treleaven et al. | 283/81 |
| 6,261,658 | B1 | | 7/2001 | Schmidt | |
| 6,268,032 | B1 | | 7/2001 | Mertens et al. | |
| 6,301,813 | B1 | * | 10/2001 | Volkert | 40/124.08 |
| 6,311,418 | B1 | * | 11/2001 | Crowell | 40/124.08 |
| 6,352,751 | B1 | | 3/2002 | Miles et al. | |
| 6,379,764 | B1 | | 4/2002 | Pusateri | |
| 6,383,591 | B1 | | 5/2002 | Miles et al. | |
| 6,398,263 | B2 | * | 6/2002 | Treleaven et al. | 283/81 |
| 6,508,020 | B2 | | 1/2003 | Volkert | |
| 6,725,588 | B1 | | 4/2004 | Swoboda | |
| RE38,696 | E | | 2/2005 | Williams | |
| 6,953,513 | B1 | * | 10/2005 | Volkert | 156/256 |
| 2004/0180170 | A1 | | 9/2004 | Mertens et al. | |
| 2006/0061084 | A1 | * | 3/2006 | Volkert | 281/21.1 |

* cited by examiner

STAND-UP ADVERTISING INSERT

BACKGROUND OF THE INVENTION

Magazine circulation in the United States reaches large audiences and is a popular way to advertise. To make a magazine advertisement more effective, advertisers sometimes attach coupons or return mail cards to a page of their advertising. However, cards and coupons that lie flat against the magazine page frequently go unnoticed by the reader.

In order to make advertising more attention-getting, it is known to provide paper sheets that are glued between facing sheets of a magazine such as to create a three-dimensional pop-up figure when the facing sheets are opened.

U.S. Pat. No. 6,953,513 describes three-dimensional pop-up structures that can be effectively created during the high-speed production of magazines. This patent describes pop-up structures that are combined with magazine pages or "signatures" so that they bridge two facing pages of a magazine so that, when the reader turns to that page, the pop-up structures "pop up", allowing the reader to flatten or remove and retain the message or dispose of the message. The message of the pop-up structure relates directly to the advertising page and is a "response trigger." An action by the reader is the response sought by the advertiser. The pop-up structure can have a reusable adhesive that allows the reader additional use options for the structure, for example, the repositioning and securing of the portion to a different portion of the magazine. The result is that the reader is more likely to review that particular advertisement because his or her attention has been drawn to it.

Today, a potential advertiser has many mediums from which to choose to invest in advertising, such as television, radio, Internet, etc. In order to compete, the print advertising media must be cost effective.

The present inventors have recognized the desirability of a print media insert card or sheet that is designed and configured to be attention-getting to the consumer while also being capable of installation into the print media at high speeds in a continuous operation, and at a reduced cost.

BRIEF SUMMARY OF THE INVENTION

The present invention provides a single sheet, folded insert design that is constructed so it can be combined with printed sheets, such as magazine signatures or other sheets, during the printing and assembly of those sheets on a high-speed web press. This insert design can be pre-printed before being added to the sheet or can be printed during the process of being added to the sheet when the sheet is being printed. The versatility of this production method which employs such a single sheet insert construction is that the FRPN piece can exist solely as an ad by itself or can also relate to either a portion of a page, the whole page, both pages on each side of the binding spine, or portions of both pages to which it attaches.

The invention provides in combination, a first printed page and a second printed page of a multi-page printed medium, the first and second printed pages having facing first and second page surfaces respectively, and an insert. The insert is located between the first and second page surfaces, the insert comprising a sheet having a fold separating a first panel and a second panel. The first panel has a first outside-facing panel surface facing the first page surface and the second panel having a second outside-facing panel surface facing the second page surface. A portion of a first adhesive is applied between the first panel surface and the first page surface and a second portion of adhesive is applied between the second panel surface and the second page surface. The second portion of adhesive has lesser adhesion than the first portion of adhesive such that when the second printed page is moved away from the first printed page the second page surface separates from the second panel surface.

Preferably, the first panel and the second panel have a bending memory along the fold such that when the second panel surface separates from the second page surface the second panel assumes a substantially right angle from the first panel.

Preferably, the first portion of adhesive comprises a reusable adhesive for removing and re-adhering the sheet.

According to the preferred embodiment the sheet is positioned spaced from all edges of the first printed page.

According to the preferred embodiment the first panel surface and the second panel surface are substantially equal in area.

The invention also provides a method of assembling printed media with inserts. The method includes the steps of:

providing a plurality of printed pages conveyed in a longitudinal direction;

providing a strip comprised of plurality of insert sheets connected end-to-end;

applying adhesive along two longitudinal stripes on the strip;

folding the strip to form a folded strip with the stripes on opposite facing surfaces of the folded strip;

separating the insert sheets to form separated insert sheets with stripe portions of adhesive on opposite facing panels of the separated insert sheets;

sequentially adhering one panel of each separated insert sheet to one printed page; and placing a second printed page over the one printed page and adhering an opposite panel of the separated insert sheet to the second page.

Preferably, the step of placing a second printed page is further defined in that the first and second printed pages are formed by a single printed sheet that is folded over in half.

Preferably, the step of providing a strip is further defined in that the strip is provided in a roll.

Particularly, a method of making multi-page media, such as magazines or catalogs, is disclosed which includes a folded repositionable note, wherein the note is operatively attached to facing pages. The method includes the steps of:

printing a plurality of signatures on a web fed press, which signatures each include at least two pairs of consecutively numbered or designated pages which are designed for assembly to create a multi-page medium;

conveying the signatures along a path as part of the assembly of a multi-page medium;

providing a plurality of notes at a location adjacent the path, which notes are folded and having pre-applied repositionable adhesive on outside surfaces thereof and each carry indicia, such note being attached to one another in a series as a strip with a line of weakness between adjacent notes, bursting each note along the line of weakness from the following note in the strip to form a separated note;

placing one of the separated notes upon a specific location on each specific page, that page traveling along the path, by moving each the separated note in the same direction and at the same speed at which the signature is traveling, and reposition-ably securing a surface of the note to the signature;

positioning an additional one of the signatures which contains a page that is consecutive with the specific page in juxtaposition therewith so that there is adherence thereto at the location of the note;

completing assembly of the magazine;

whereby the note becomes reposition-ably attached between two facing consecutive pages to form a stand-up structure such that, when a recipient of the magazine or catalog opens same to spread consecutive two signature pages, the note assumes an attention-attracting standing configuration.

Preferably the note carries the repositionable adhesive on the outside surface and the notes are fed from a roll which presents a continuous strip of notes to a burster or which grasps the strip in regions and separates the individual note from the strip.

If needed, the repositionable adhesive can be covered by a release coating or film to prevent unwanted adherence of the adhesive to the strip handling equipment, and the release coating or film can be stripped off before the inserts are placed on the pages.

Advantageously, the signatures are being moved at a linear speed sufficient to allow placing and securing of over 50,000 of the notes per hour.

Preferably, the note is placed and adhesively secured in a manner to attach one note to each the signature when the signatures are being moved at a linear speed that may exceed 40 linear feet per second.

The invention can provide a method of making magazines which includes a note structure wherein a folded repositionable note is operatively attached between facing pages, which method comprises the steps of:

printing a plurality of signatures which each include at least two pairs of consecutively numbered or designated pages and which are designed for assembly to create a magazine, at least one specific page of the pairs carrying particular advertising;

conveying the signatures along a path as a part of ultimate assembly of the magazine;

at a location adjacent the path, providing a continuous strip that is formed of a plurality of notes, interconnected head-to-tail, which notes carry indicia related to the particular advertising and carried repositionable adhesive on the outside the notes, the notes being attached one another in series as a strip with a line of weakness between adjacent notes;

bursting each the note along the line of weakness from the following note in the strip;

moving the burst notes into juxtaposition with the signatures being conveyed so the note is traveling in the same direction, and adhesively securing a first adhesive-bearing surface of the burst notes at a specific location on the one page as that page is traveling along the path;

positioning an additional one of the signatures which carries the other page of the two consecutive pages in juxtaposition therewith so that a second adhesive-bearing surface of the burst note becomes attached thereto; and completing assembly of the magazine or catalog wherein all the signatures are folded about the additional signature;

whereby the note becomes adhesively attached between the two facing consecutive pages to form a stand-up structures such that, when a recipient of the magazine opens same to spread two pages of the one pair, the note assumes an attention-attracting stand up configuration.

The improvements presented herein eliminate a very significant amount of production time and material cost compared to the heretofore known pop-up inserts and methods for installing the inserts. The improvement provides a simple, versatile stand-up insert that is an effective attention-getting advertising means.

Numerous other advantages and features of the present invention will be become readily apparent from the following detailed description of the invention and the embodiments thereof, and from the accompanying drawings.

DETAILED DESCRIPTION OF THE PREFERRED EMBODIMENT

Figure 1:
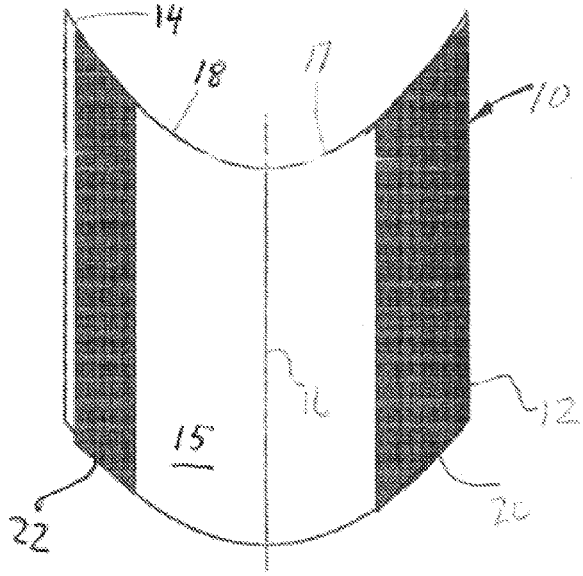
FIG. 1 is a perspective view of an insert according to the invention.

While this invention is susceptible of embodiment in many different forms, there are shown in the drawings, and will be described herein in detail, specific embodiments thereof with the understanding that the present disclosure is to be considered as an exemplification of the principles of the invention and is not intended to limit the invention to the specific embodiments illustrated.

FIG. 1 illustrates an insert 10 for installation in a multi-page printed medium, such as a magazine or catalog, comprising a sheet 12 having an inside surface 14 and an outside surface 15 defined after the sheet 12 is folded about the fold line 16. The fold line 16 defines a first sheet portion 17 and a second sheet portion 18. On the outside surface 15, a first strip of adhesive 20 is applied to the first sheet portion 17, and a second strip of adhesive 22 is applied to the second sheet portion 18.

Figure 2:
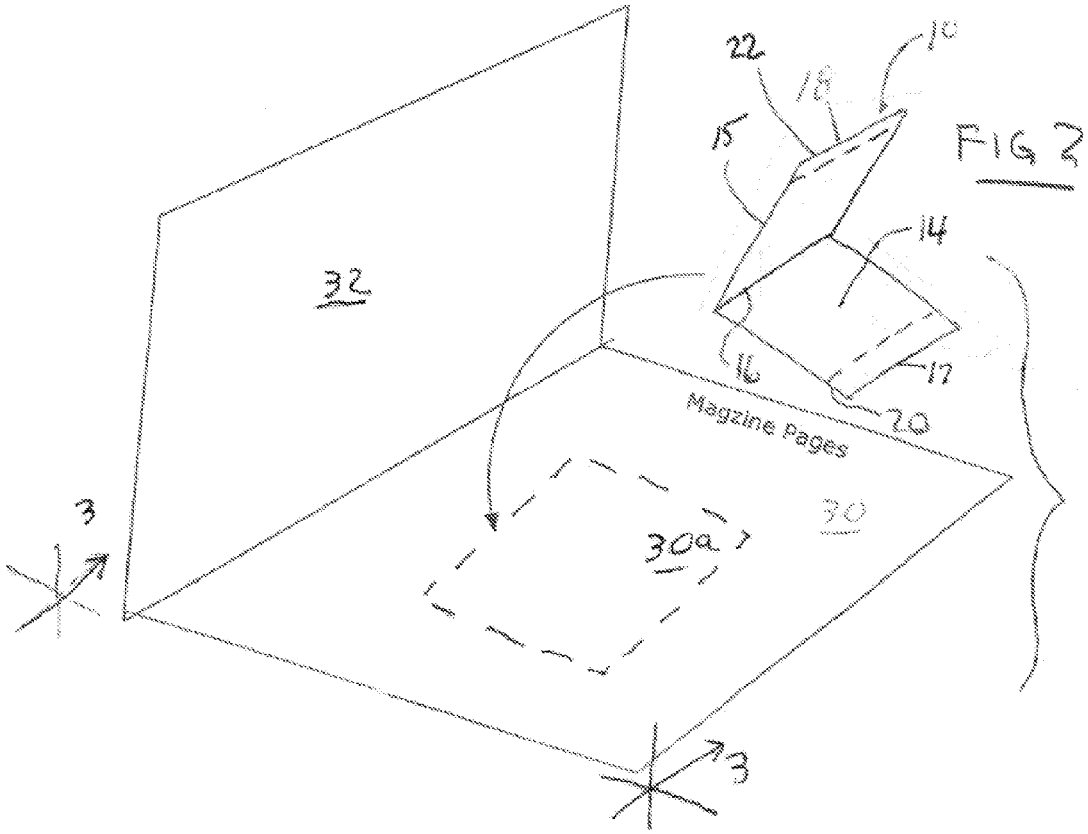
FIG. 2 is an exploded perspective view of the insert of FIG. 1 applied to a magazine.

FIG. 2 illustrates the insert 10 to be applied to a magazine page 30 within an area 30*a* of the page 30. A second magazine page 32 can be a folded continuation of the page 30 or a separate sheet bound or otherwise associated with the page 30.

Figure 3:
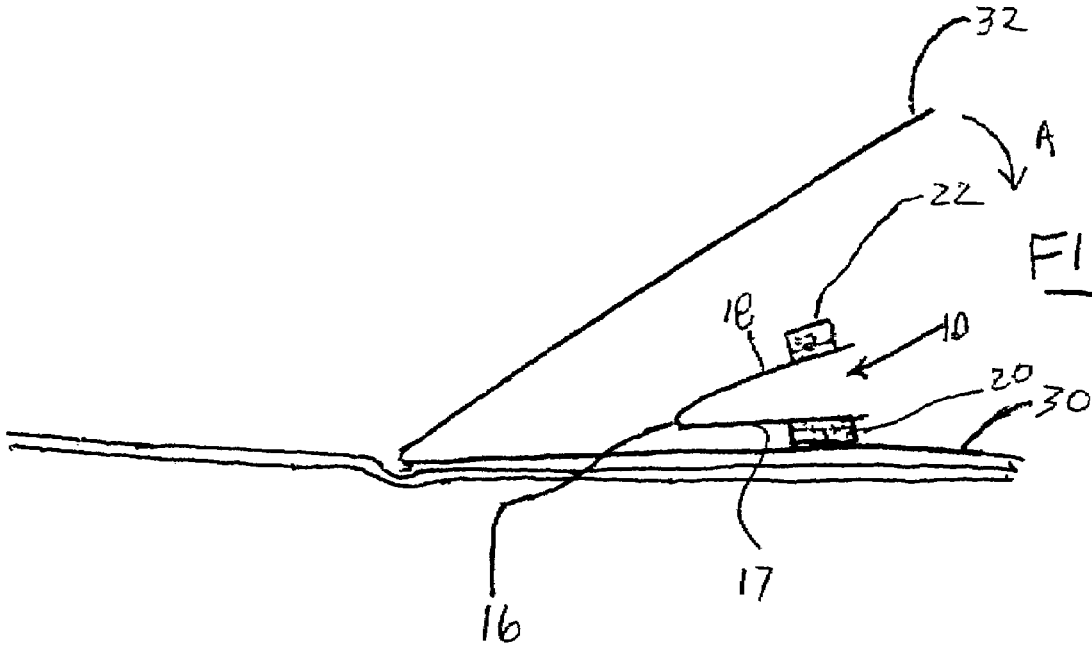
FIG. 3 is a diagrammatic end view of a magazine being assembled onto the insert.
Figure 4:
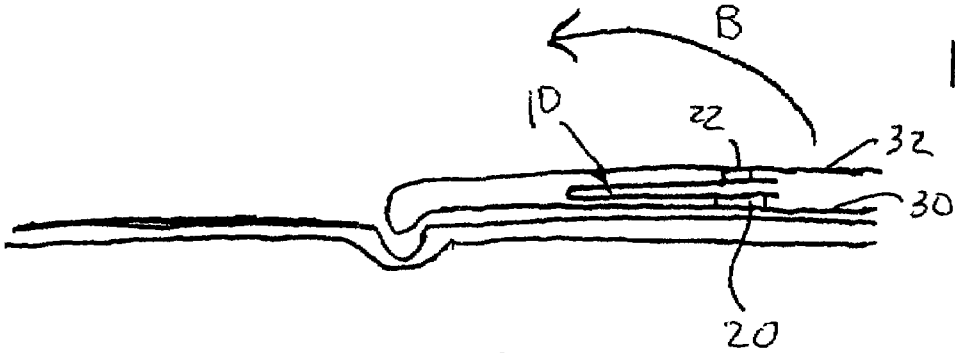
FIG. 4 is a diagrammatic end view of the magazine of FIG. 3 being opened by a reader to expose the insert.

As illustrated in FIG. 3, the insert 10 is secured to the page 30 by way of the first strip of adhesive 20. As illustrated in FIG. 4, once the page 32 is rotated completely in the direction A (FIG. 3), or otherwise placed onto the insert 10, the second strip of adhesive 22 is temporarily secured to the page 32.

The first strip of adhesive 20 and the second strip of adhesive 22 are preferably configured such that the first strip of adhesive 20 has a higher bonding strength to the page 30 than does the second strip of adhesive 22 to the page 32. Alternatively, the second strip of adhesive 22 can have a higher bonding strength to the page 32 than does the first strip of adhesive 20 to the page 30. The differential bonding strength can be achieved by having the same adhesive strength per area but varying the adhesive area between the strips 20, 22, or having equal areas and varying the chemical adhesive strength per area of the strips 20, 22, or a combination of the two techniques.

Figure 5:
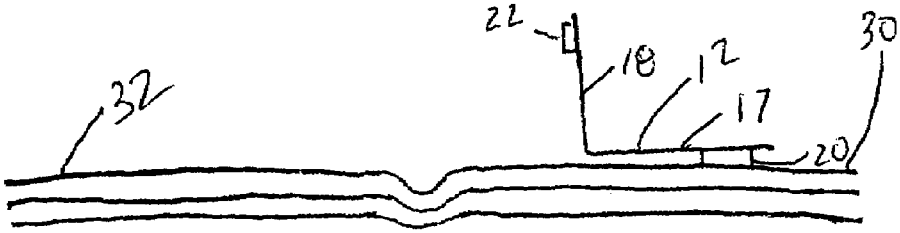
FIG. 5 is a diagrammatic end view of the magazine of FIG. 4 in an opened configuration.

As shown in FIG. 5, given the example that the first strip of adhesive 20 has a higher bonding strength than the second strip of adhesive 22, when the page 32 is opened away from the page 30, the first strip of adhesive 22 releases from the page 32, while the first strip of adhesive 20 retains the first sheet portion 17 down flat onto the page 30. The insert sheet 12 is configured to have a material quality and thickness to have a folding memory such that when the first sheet portion 18 is released from the page 32, the first sheet portion assumes an attention-getting, two-dimensional, stand-up configuration.

Figure 6:
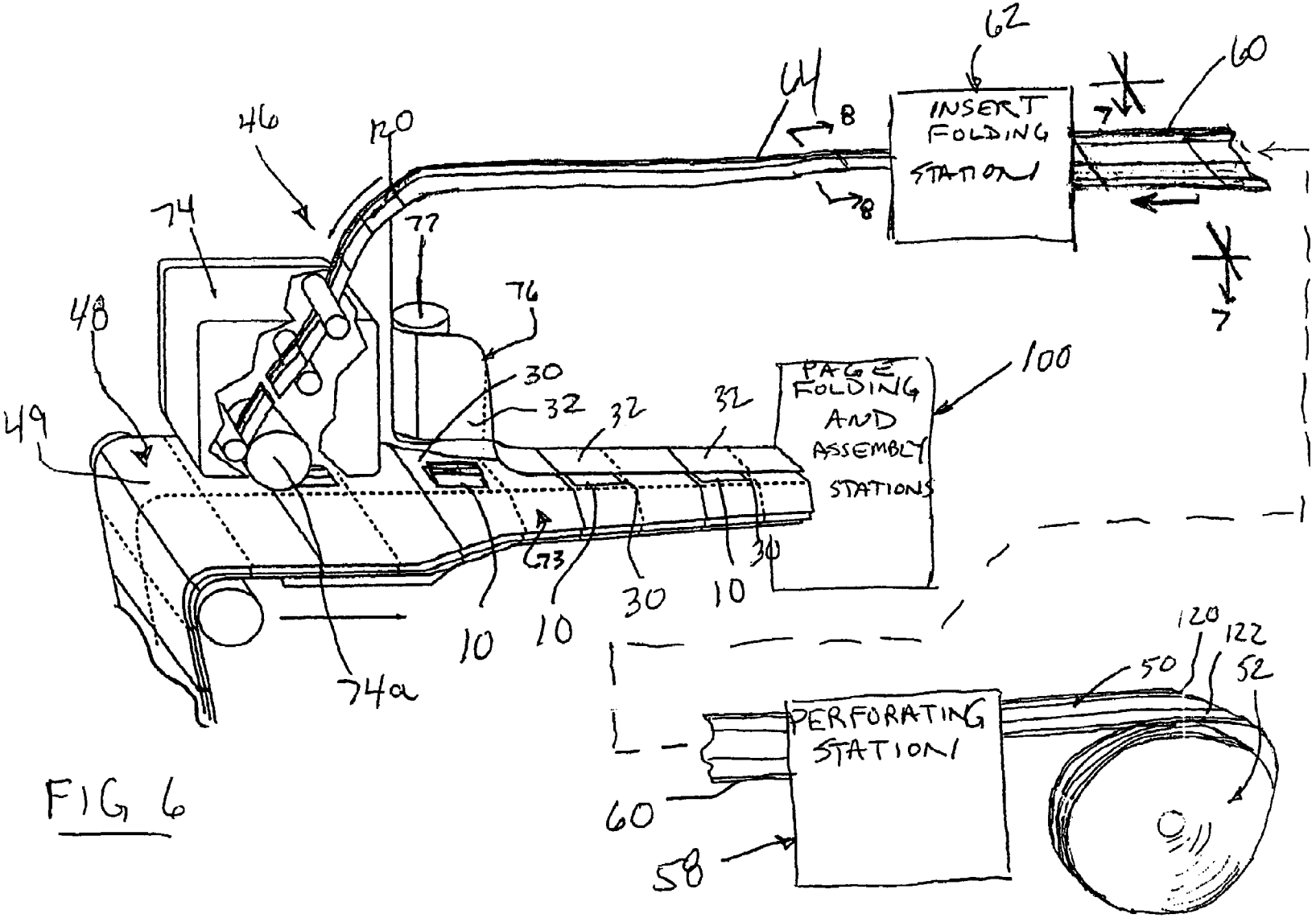
FIG. 6 is a diagrammatic fragmentary perspective view of a layout of an in-line finishing line integrated as part of a high-speed web press for printing magazines.

FIG. 6 illustrates a method of placing the inserts 10 between the pages 30, 32 in a finishing line 46 which is typical of that used with a high speed, inline web press, particularly a press of the rotogravure type, for printing magazines. The components of the press might be run at a speed of about up to 46 ft/sec in a typical high speed production run and require the affixation of up to about 100,000 stand-up inserts per hour to produce a magazine such as the PARADE magazine in Sunday newspapers across the United States.

At the beginning of the insert line, an insert strip 50 is fed from a roll 52. The stand-up inserts 10 have been pre-printed on the insert strip 50. The insert strip also includes longitudinal stripes 120, 122 (FIG. 7) of pressure-sensitive adhesive and a release material applied over the stripes 120, 122.

Figure 7:
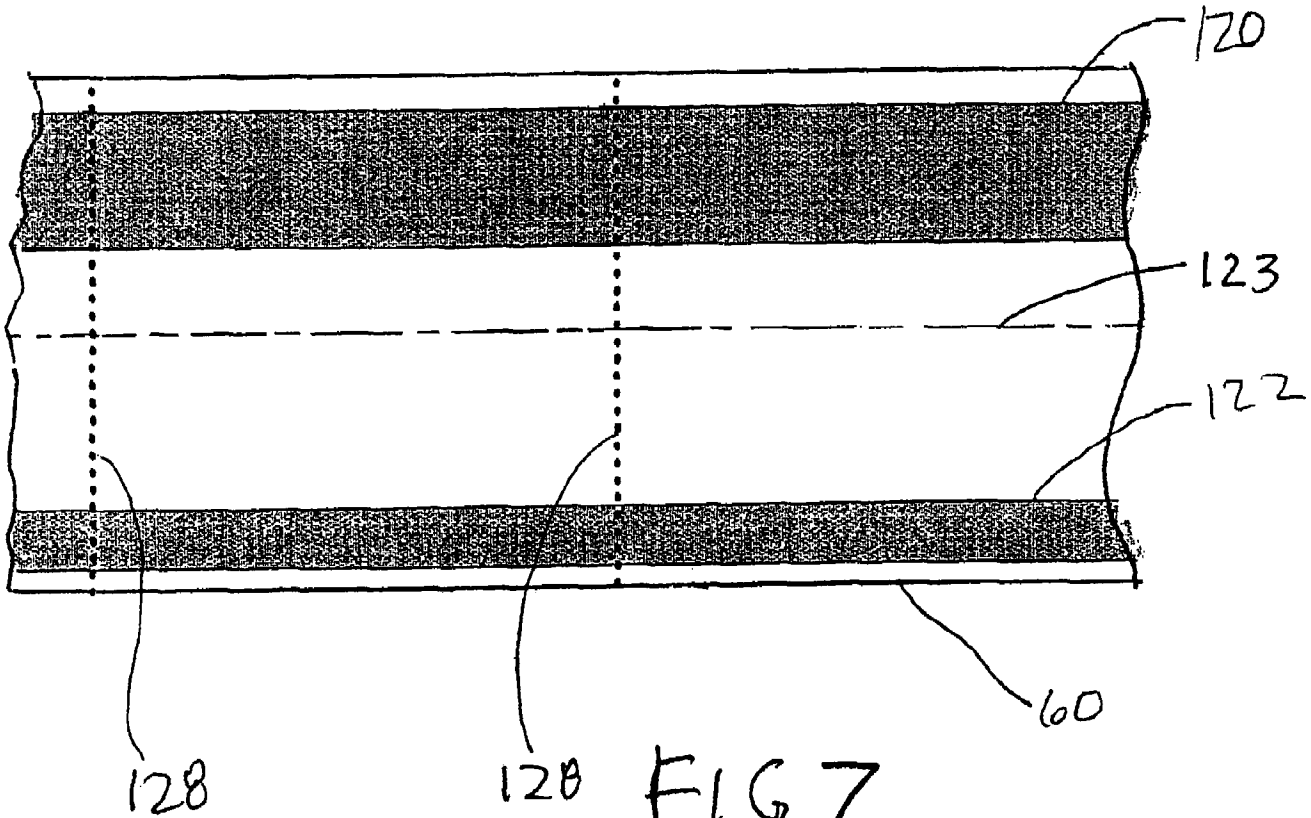
FIG. 7 is a plan view taken generally along line 7-7 of FIG. 6.

The insert strip 50 is dispensed to a perforating station 58 where the insert strip is perforated incrementally, corresponding to the length of each insert 10, across its width along transverse lines of perforations 128 seen in FIG. 7, to create a perforated strip 60. The perforated strip 60 is fed to an insert folding station 62 where the perforated strip is folded about its centerline to create a folded strip 64.

Alternately, the insert strip 50 from the roll could be fed through the folding station 62 first and then the perforating station 58.

The folded strip 64 is dispensed to a bursting and placing apparatus 74 that separates individual inserts 10 from the folded strip 64 and places the inserts 10 on the pages 30 according to a pre-selected timing sequence. The inserts 10 are secured to the page 30 by the first strip of adhesive 20.

The burster/placer 74 is designed to grasp the strip in regions that avoid contact with the pressure-sensitive adhesive pattern at the foot of the leg, so it does not come in contact with the machinery. A fast-rotating vacuum cylinder 74*a* may be used, the surface of which may be plasma-coated so that there will be no adherence at the pressure-sensitive adhesive.

The page 30 is shown as part of a signature page 73 having plural pages printed on a fast moving ribbon 75. The cylinder 74*a* removes a lead insert 10. The now separated lead insert 10 is placed onto the desired page 30 of the fast-moving ribbon 75 within a close tolerance of a desired location, and the strip of adhesive 20 secures the insert 10 to the page 30. The cylinder 74*a* is synchronized with the moving ribbon 75; by the time the next page 30 reaches this location, the next stand-up insert 10 in line has been separated and conveyed to meet the next page 30.

According to the illustrated example, the succeeding page 32 is part of a fast moving centerspread ribbon 76 delivered from a roll 77. The moving centerspread ribbon is synchronized with movement of the ribbon 75 so that page 32 overlies the corresponding preceding page 30.

The second strip of adhesive 22 on the folded insert 10, facing upwardly, engages the succeeding page 32. The pages are moved into page folding, cutting and forming stations in a conventional manner to form the magazine from the signatures and the centerspread ribbon. A description of this procedure is described in U.S. Pat. No. 6,953,513, herein incorporated by reference.

Although FIG. 6 illustrates the inserts being placed between a top ribbon of a plurality of signatures and a centerspread ribbon, the inserts could also be placed upstream of the position shown and placed between ribbons of signatures as those ribbons are brought into juxtaposition.

Furthermore, more than one insert applicator 74 can be used if desired either to feed alternately at slower speeds or to incorporate two stand-up inserts at different locations within a magazine.

FIG. 7 illustrates a portion of the strip before folding and after adhesive application and perforating. The strip 60 includes an elongated ribbon having the first elongated stripe of adhesive 120 adjacent one edge and the second elongated stripe of adhesive 122 adjacent an opposite edge. As the inserts 10 are separated by the burster and placer 74, the first stripe of adhesive 120 forms the first strips of adhesive 20 and the second stripe of adhesive 122 forms the second strips of adhesive 22. The strip 60 includes lateral lines of perforation or weakness which defines the length of each insert 10 to be separated from the ribbon. The ribbon includes a longitudinal centerline 123 which preferably also defines the location of the fold 16 for each insert.

Figure 8:
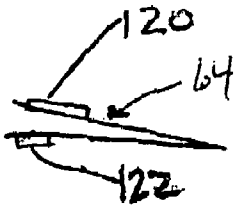
FIG. 8 is a sectional view taken generally along line 8-8 of FIG. 6

FIG. 8 illustrates a cross-section of the folded stock 64 downstream of the folding station 62.

The insert 10 can carry adhesive prior to its being added to the sheet assemblage as described, or it can have adhesive applied either to it or to the sheets 30, 32 as the insert 10 is being added to the sheet assemblage 30, 32. An adhesive applicator can be configured to be within the bursting and placing station 74 to apply the adhesive stripes 120, 122 before or after bursting individual inserts 10 from the stock 70.

Any suitable adhesive of the variety of adhesives available may generally be used. A preferred adhesive is a reusable pressure sensitive adhesive such as used for POST IT™ notes or a pressure sensitive repositionable acrylate copolymer adhesive as described in U.S. Pat. No. 3,691,140. This adhesive provides the additional benefit that once the succeeding page 32 is separated from the insert 10 by a reader opening the page 32 from the page 30, and after the sheet portion 18 of the insert 10 has automatically assumed an upright, two-dimensional, attention-getting orientation, the insert 10 can be removed by the reader from the page 30 and repositioned elsewhere, such as extending from the margin of the page as a bookmark, or on a sheet or object separate from the pages 30, 32 as a reminder to follow-up on the advertised product.

When the stand-up insert bears self-contained (previously applied) adhesive, pathways are provided for the exposed adhesive to travel without contact. For example, if rollers drive the stand-up insert or strip thereof through the unit, then areas on the rollers will have channels to avoid contact with the adhesive yet still drive and convey the strip or insert.

Alternatively, the strip 50 can have a release coating or film overlying the adhesive stripes 120, 122, to prevent adherence to the strip handling equipment, wherein the release coating or film can be stripped away at the burster/placer 74 before placing the inserts 10 on the pages 30.

Alternately to the mechanism shown in FIG. 6, there are different means of feeding the inserts 10 to the pages such as from stacks, rolls, etc. The type of feeding equipment shown is an example, and others are known in this art such as those described in U.S. Pat. No. 6,953,513, herein incorporated by reference.

From the foregoing, it will be observed that numerous variations and modifications may be effected without departing from the spirit and scope of the invention. It is to be understood that no limitation with respect to the specific apparatus illustrated herein is intended or should be inferred.

The invention claimed is:

1. In combination, a first printed page and a second printed page of a multi-page printed medium, the first and second printed pages having facing first and second page surfaces respectively, the first and second pages having outer edges and inner edges, wherein during reading of the multi-page printed medium, the outer edge of the second page is displaced from the outer edge of the first page by rotation of the second page about its inner edge with respect to the first page; and an insert located between the first and second page surfaces, the insert comprising a sheet having a fold separating a first panel and a second panel, the first panel having a first outside-facing panel surface facing the first page surface and the second panel having a second outside-facing panel surface facing the second page surface, a portion of a first adhesive applied between the first outside-facing panel surface and said first page surface and a second portion of adhesive applied between said second outside-facing panel surface and said second page surface, said second portion of adhesive having lesser adhesion than said first portion of adhesive such that when said outside edge of said second printed page is moved away from said outside edge of said first printed page, said second page surface separates from said second outside-facing panel surface and said first page surface and said first outside-facing panel remain adhered, and before separating from said second page surface, said second panel is automatically pulled by said second printed page into an upstanding position with respect to said first printed page.

2. The combination according to claim 1, wherein said first panel and said second panel have a bending memory along said fold such that when said second outside-facing panel surface separates from said second page surface said second panel assumes a substantially right angle from said first panel.

3. The combination according to claim 2, wherein said first portion of adhesive comprises a reusable adhesive for removing and re-adhering said sheet.

4. The combination according to claim 1, wherein said first portion of adhesive comprises a reusable adhesive for removing and re-adhering said sheet.

5. The combination according to claim 1, wherein said sheet is positioned spaced from all edges of said first printed page.

6. The combination according to claim 1, wherein said first outside-facing panel surface and said second outside-facing panel surface are substantially equal in area.

* * * * *